US009738099B2

(12) United States Patent
Scheffelin et al.

(10) Patent No.: US 9,738,099 B2
(45) Date of Patent: Aug. 22, 2017

(54) PRINTHEAD ASSEMBLY DATUMING

(71) Applicant: HEWLETT-PACKARD DEVELOPMENT COMPANY, L.P., Houston, TX (US)

(72) Inventors: Joseph Scheffelin, Poway, CA (US); Daniel Gonzalez Perello, Sant Cugat del Valles (ES); Joaquim Brugue Garvi, Sant Cugat del Valles (ES); Rafael Ulacia Portoles, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/205,257

(22) Filed: Jul. 8, 2016

(65) Prior Publication Data

US 2016/0318322 A1 Nov. 3, 2016

Related U.S. Application Data

(63) Continuation of application No. 14/557,066, filed on Dec. 1, 2014, now Pat. No. 9,440,442.

(51) Int. Cl.

| | |
|---|---|
| ***B41J 25/00*** | (2006.01) |
| ***B41J 2/145*** | (2006.01) |
| ***B41J 19/00*** | (2006.01) |

(52) U.S. Cl.
CPC ..... *B41J 25/001* (2013.01); *B41J 2/145* (2013.01); *B41J 19/00* (2013.01)

(58) Field of Classification Search
CPC ..... B41J 25/001; B41J 2/145
See application file for complete search history.

(56) References Cited

U.S. PATENT DOCUMENTS

| | | | | |
|---|---|---|---|---|
| 9,440,442 | B2 * | 9/2016 | Sheffelin | B41J 2/145 |
| 2011/0141192 | A1 | 6/2011 | Komuro et al. | |
| 2012/0019593 | A1 * | 1/2012 | Scheffelin | B41J 2/14024 347/40 |

FOREIGN PATENT DOCUMENTS

WO WO2013112168 A1 * 1/2013

* cited by examiner

*Primary Examiner* — Jason Uhlenhake
(74) *Attorney, Agent, or Firm* — HP Inc. Patent Department

(57) ABSTRACT

In one example, a datuming system to position a printhead assembly relative to a component external to the printhead assembly includes a first datum on the printhead assembly to establish a first plane, a first line, and a first point and a second datum on the printhead assembly to establish a second plane orthogonal to the first plane, a second line, and a second point.

14 Claims, 9 Drawing Sheets

PRINTHEAD ASSEMBLY DATUMING

CROSS REFERENCE TO RELATED APPLICATIONS

This application is a continuation of co-pending application Ser. No. 14/557,066 filed Dec. 1, 2014 titled Printhead Assembly Datuming.

BACKGROUND

In some inkjet printers, a substrate wide printhead assembly or group of printhead assemblies commonly referred to as a "print bar" is used to print on paper or other print substrates moving past the print bar. Print bars include a datuming system that allows the printhead assemblies to be properly positioned in the printer.

DRAWINGS

The same part numbers are used to designate the same or similar parts throughout the figures.

DESCRIPTION

A datuming system is used to properly position a print bar, print bar module or other inkjet type printhead assembly in a printer. For more complex printhead assemblies, it may be desirable for the datuming system to also properly position printhead parts for assembly during manufacturing. The datuming criteria for assembly, however, may be different from the datuming criteria for printing. Thus, it may not be desirable to use the same set of datum points for assembly and for printing.

A new datuming system has been developed for an inkjet print bar module to help optimize datuming for both assembly and printing. The new system uses one set of datum points for assembly and a second set of datum points for printing while still allowing a compact print zone and efficient paper path inside the printer. In one example, a first group of three datum points establishes a horizontal plane as the primary datum to position the module in an assembly fixture and a second group of three datum points establishes a vertical plane as the primary datum to position the module in a printer chassis. In one specific implementation, the primary, secondary, and tertiary datums for both assembly and printing are established by only seven datum points in which (1) both datums share five of the seven datum points and (2) all six of the assembly datum points are formed on a single part.

Although the new, dual datuming system was developed for a printhead assembly module in a modular print bar, examples of the new system could also be implemented in a single substrate wide print bar, in a carriage mounted ink pen, or in other printhead assembly configurations. Thus, the examples shown in the figures and described herein illustrate but do not limit the claimed subject matter, which is defined in the Claims following this Description.

As used in this document, a "datum" means something used as a basis for positioning, measuring or calculating; a "printhead" means that part of an inkjet printer or other inkjet type dispenser for dispensing fluid from one or more openings, for example as drops or streams; a printhead assembly is an assembly with one or more printheads and may include, for example, flow structures to carry printing fluid to the printhead(s); and a "print bar" means a structure or device holding an arrangement of one or more printheads or printhead assemblies that remains stationary during printing. "Printhead", "printhead assembly", and "print bar" are not limited to printing with ink but also include inkjet type dispensing of other fluids and/or for uses other than printing. "Horizontal" and "vertical" and other terms of orientation or direction are determined with reference to the usual orientation of a printhead assembly when installed in a printer for printing (in which the printheads face downward).

Figure 1:
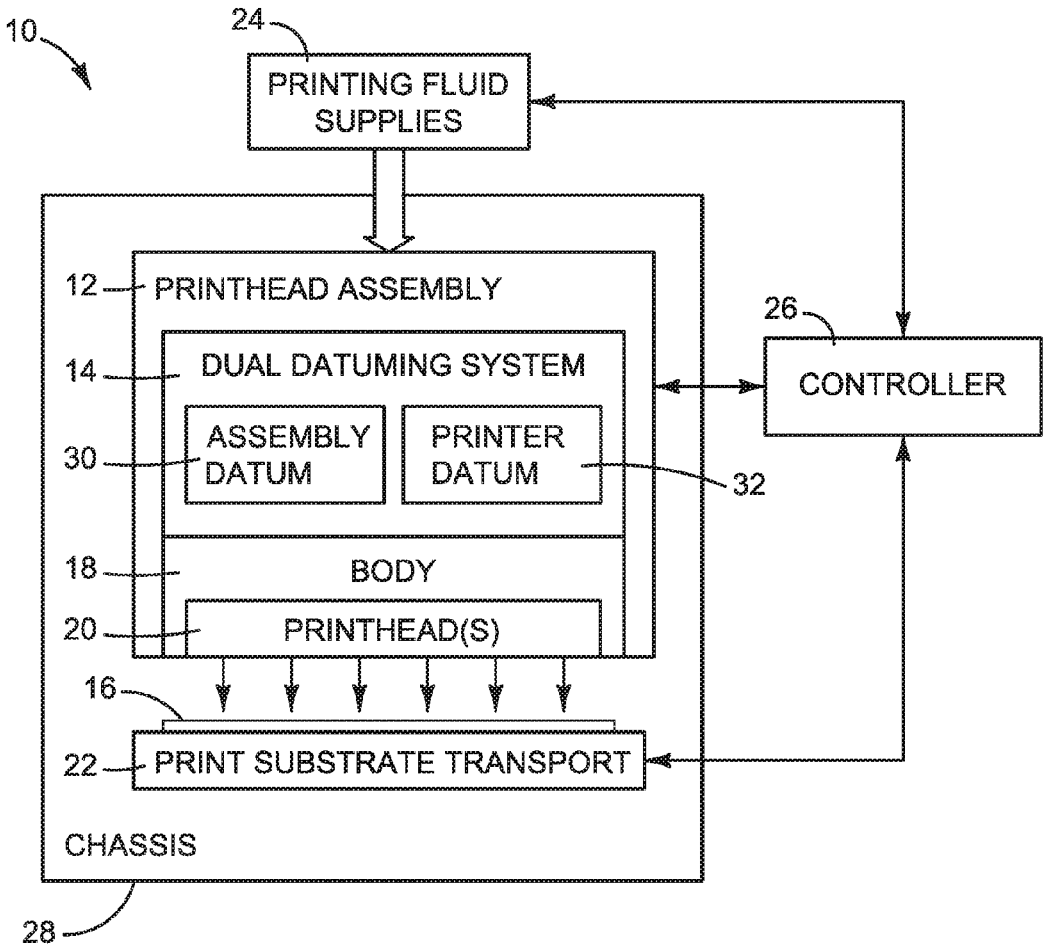
FIG. 1 is a block diagram illustrating an inkjet printer implementing one example of a printhead assembly with a dual datuming system.

FIG. 1 is a block diagram illustrating an inkjet printer 10 implementing one example of a printhead assembly 12 with a dual datuming system 14. Referring to FIG. 1, printer 10 includes a printhead assembly 12 to print on a print substrate 16. Printhead assembly 12 includes a body 18 supporting an arrangement of one or more printheads 20 for dispensing ink or other printing fluid on to a sheet or continuous web of paper or other print substrate 16. Printer 10 also includes a print substrate transport 22 to move substrate 16, printing fluid supplies 24 to supply printing fluid to printhead assembly 12, and a controller 26. Controller 26 represents the programming, processor(s) and associated memories, and the electronic circuitry and components needed to control the operative elements of printer 10. A chassis 28 supports printhead assembly 12 and other elements of printer 10. As described in detail below, dual datuming system 14 includes a first, assembly datum 30 used to position printhead assembly 12 during assembly and a second, printer datum 32 to position printhead assembly 12 in a printer chassis 28.

Figure 2:
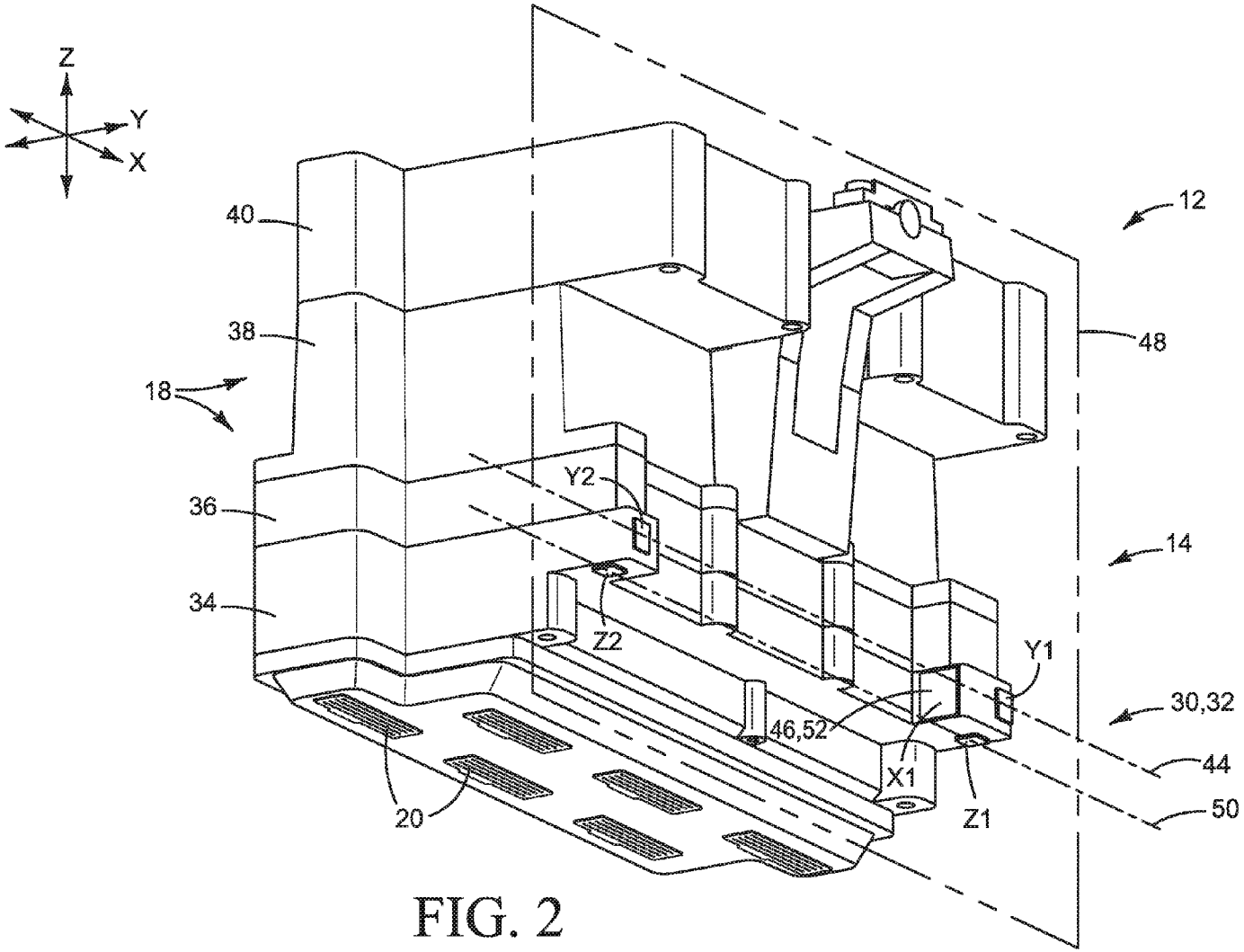
FIGS. 2-4 illustrate one example of a printhead assembly with a dual datuming system such as might be used in the printer shown in FIG. 1.
Figure 3:
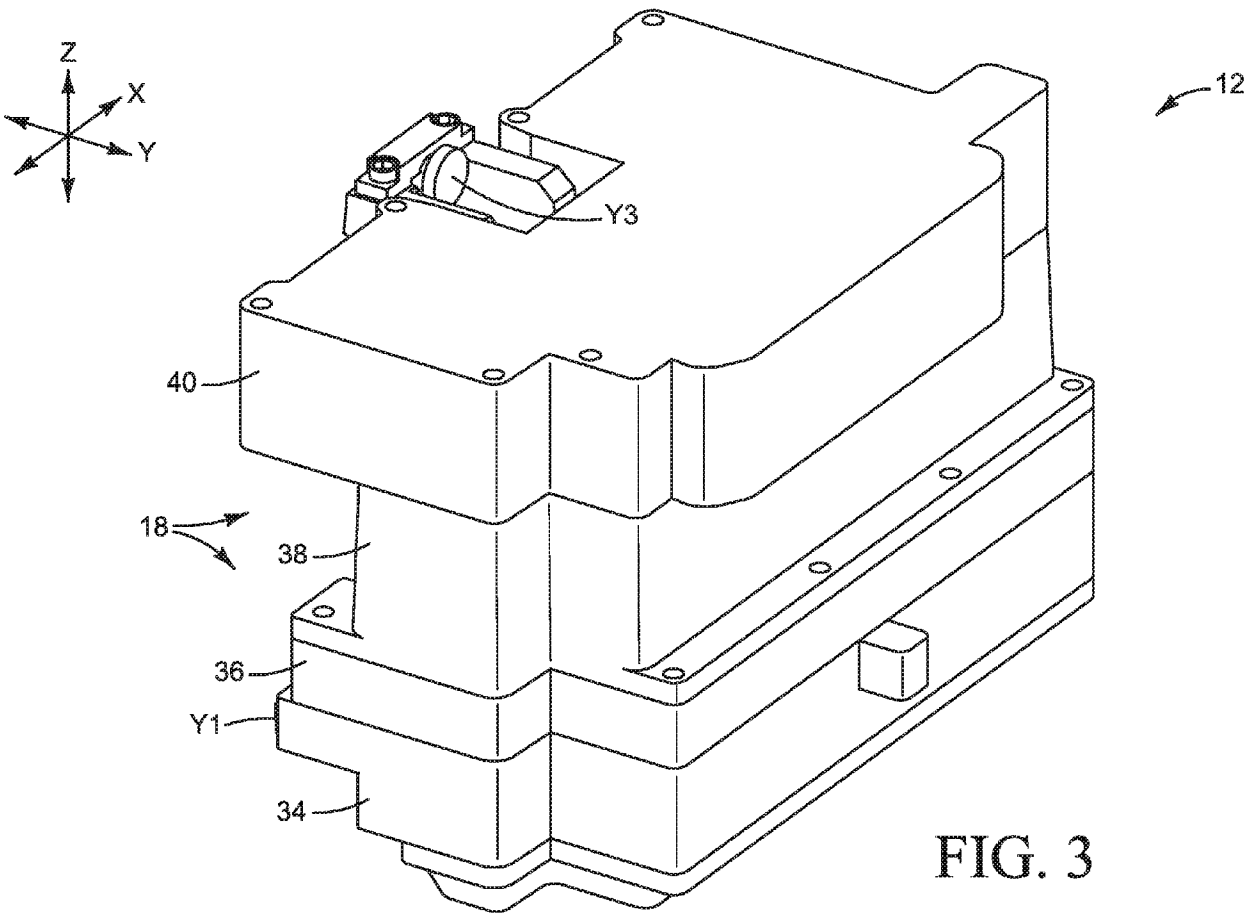
Figure 4:
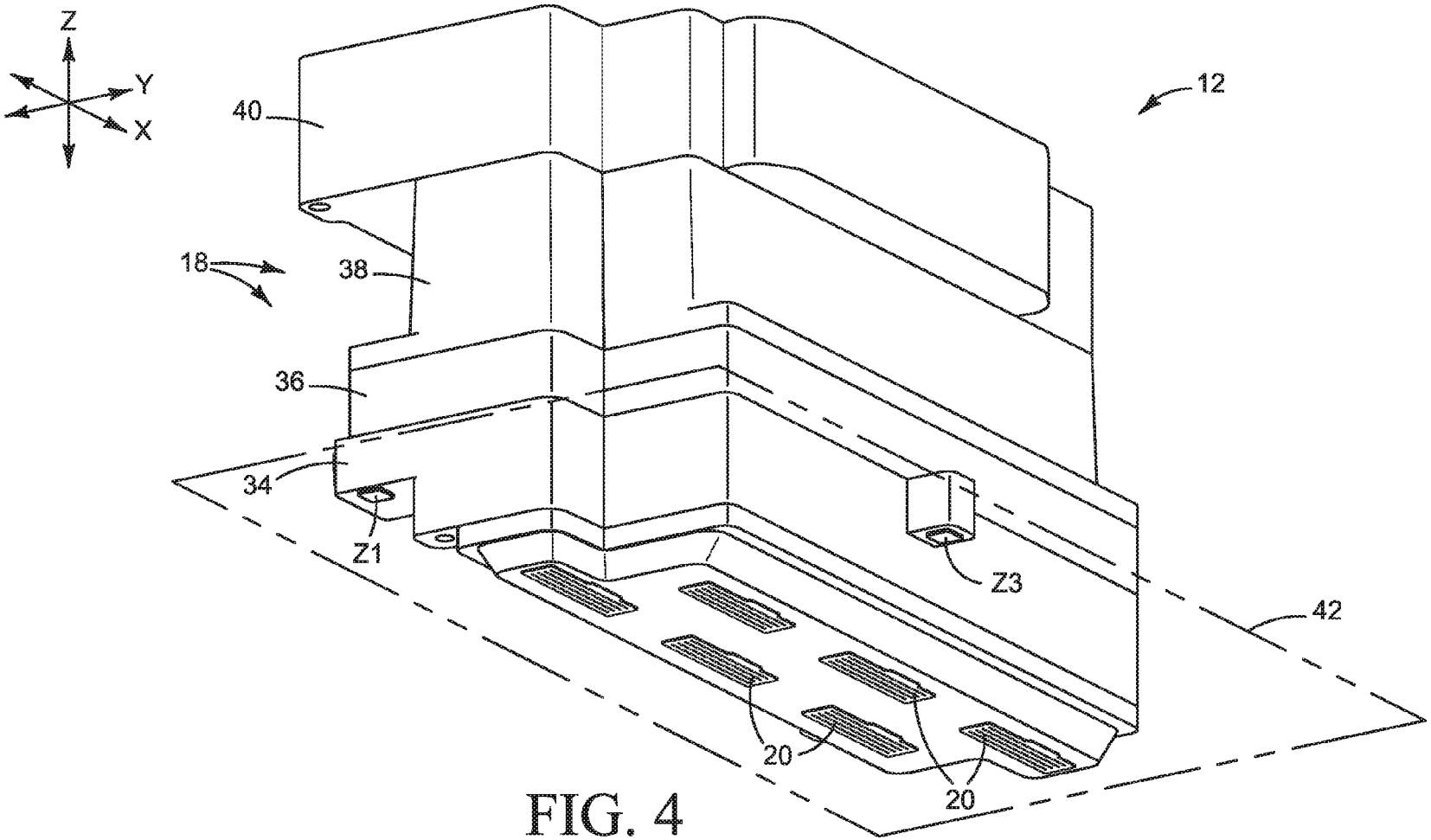
Figure 5:
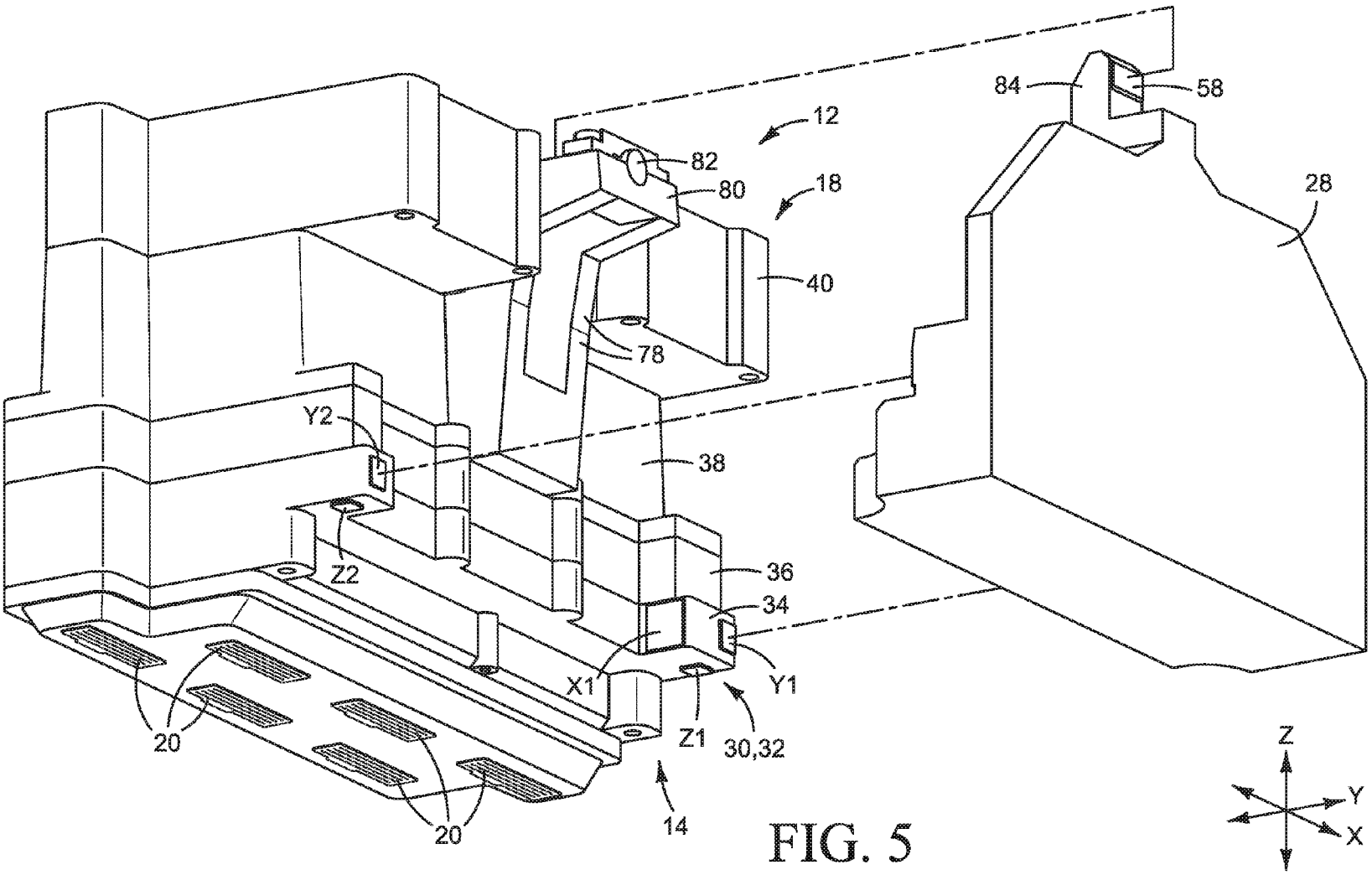
FIGS. 5-8 illustrate one example of mounting the printhead assembly of FIGS. 2-4 into a printer chassis.
Figure 6:
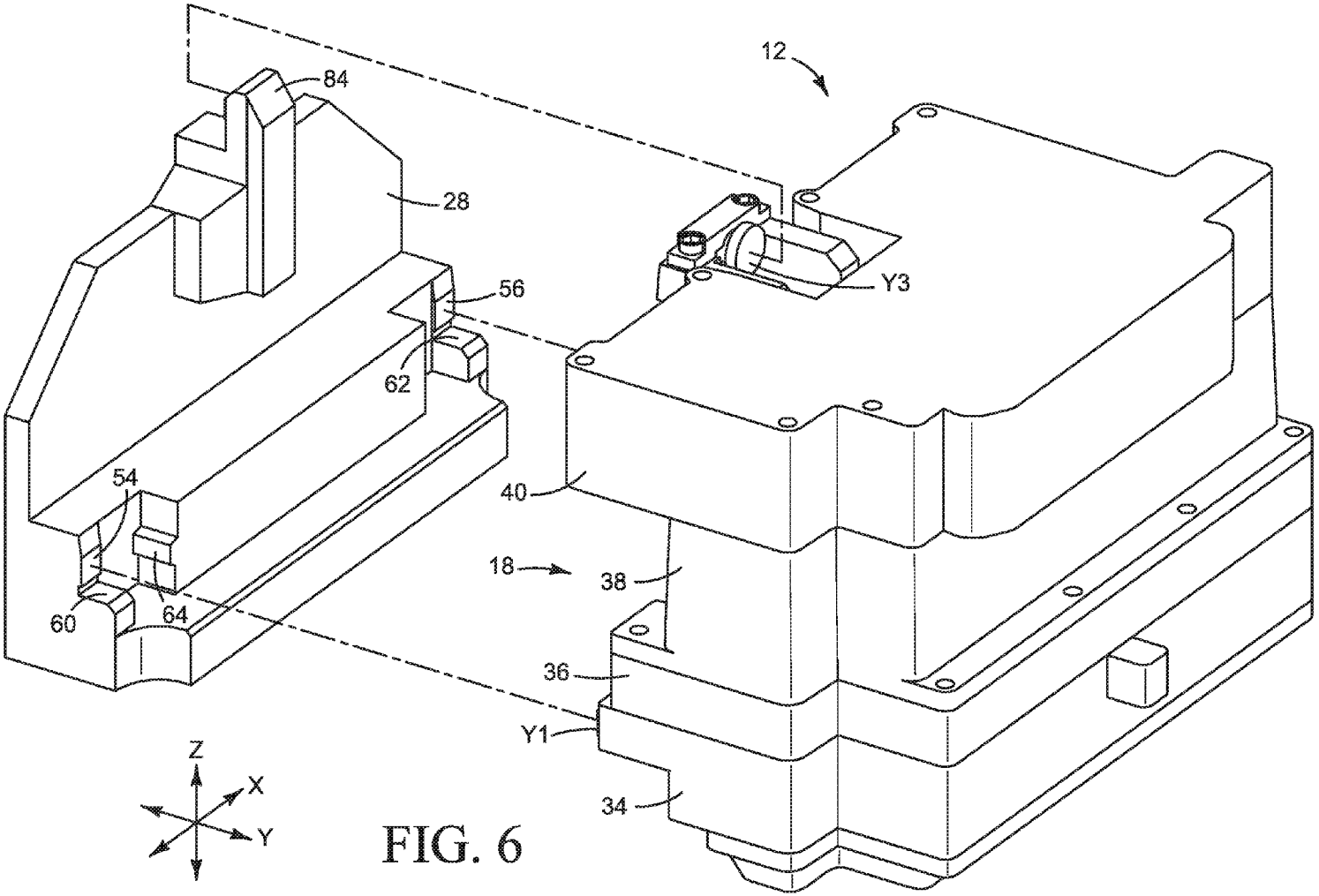
Figure 8:
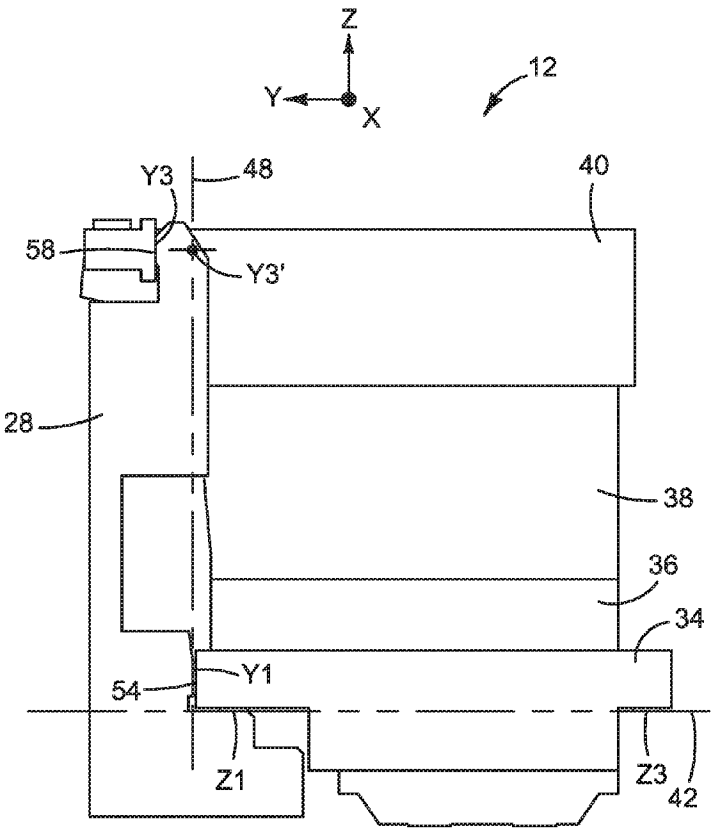
Figure 9:
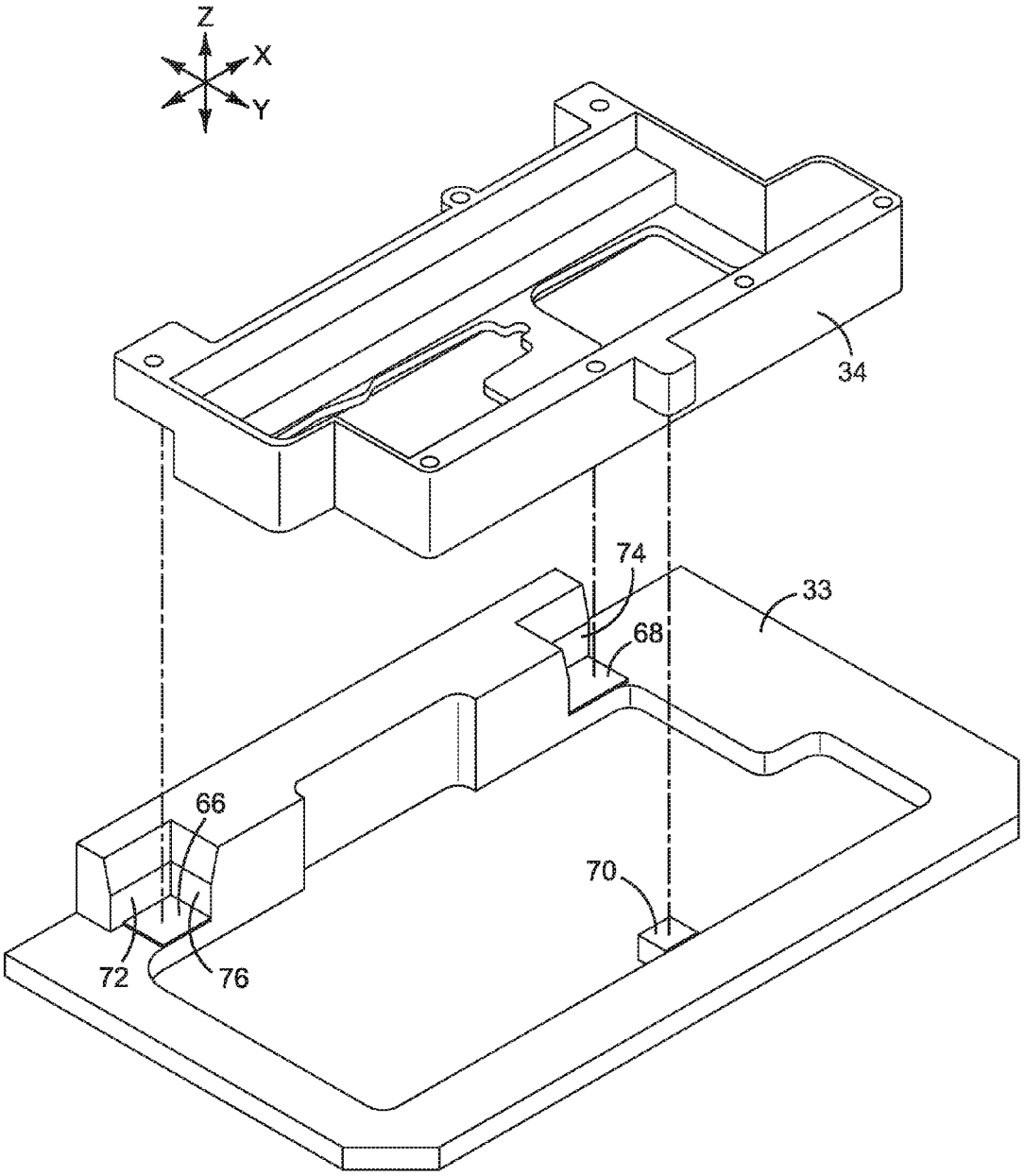
FIGS. 9 and 10 illustrate one example of mounting a printhead assembly body into an assembly fixture for assembling a printhead assembly such as the one shown in FIGS. 2-4.
Figure 10:
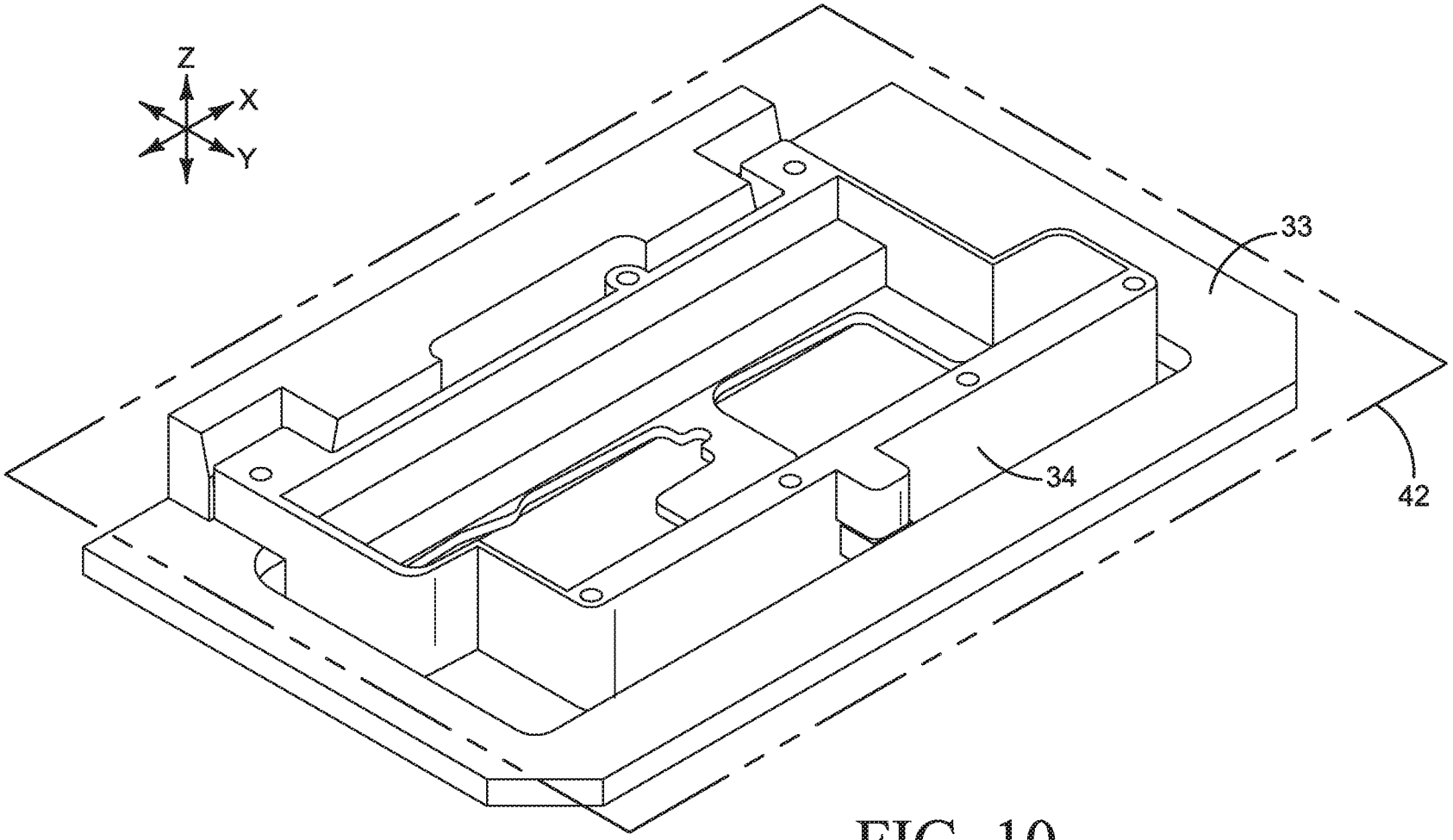

FIGS. 2-4 illustrate a printhead assembly 12 with a dual datuming system 14 such as might be used in the printer shown in FIG. 1. FIGS. 5-8 illustrate mounting printhead assembly 12 into a printer chassis 28 with printer datum 32. Printer chassis 28 in FIGS. 2-8 represents generally only that part of a printer's chassis that supports printhead assembly 12. A printer chassis is a typically complex structure with multiple parts to support different components and assemblies within the printer, including a printhead assembly 12 or group of printhead assemblies 12. FIGS. 9 and 10 illustrate mounting a printhead assembly body part in an assembly fixture 33 with assembly datum 30. A printhead assembly 12 such as that shown in FIGS. 2-4 may be implemented, for example, as a print bar that itself spans substantially the full width of a print substrate, one of a group of print bar modules that together span a print substrate, or a carriage mounted scanning type ink pen.

Referring first to FIGS. 2-4, printhead assembly body 18 includes a lower body 34 that supports multiple printheads 20 and houses fluid flow parts (not shown) to carry printing fluid to printheads 20. Body 18 also includes a flow distribution manifold 36, an upper body 38 that houses flow control elements (not shown), and a cover 40. Other suitable configurations for a printhead assembly 12 are possible. For example, fewer or more body parts may be used and the size, shape and function of each part may be different from those shown. Presently it is difficult to cost effectively fabricate the complex fluid flow paths and containment and support structures in a single part for some of the wider printhead assemblies used in print bars. Thus, for wider printhead assemblies these elements are formed in multiple parts glued, welded, screwed or otherwise fastened to one another, for example as shown in FIGS. 2-4. Also, an assembly of multiple parts facilitates the selective use of metal and other higher cost materials in combination with plastic and other lower cost materials. For example, where, as here, the datum points are located on body parts 36 and 38, those parts may be metal to provide a rigid framework for accurately mounting other parts and for datuming the printhead assembly. The fluid flow structures in manifold 36, by contrast, may be plastic and sandwiched between metal parts 36 and 38 for the desired structural support and positioning.

Continuing to refer to FIGS. 2-4, first/assembly datum 30 includes a primary datum 42 (FIG. 4), a secondary datum 44 (FIG. 2), and a tertiary datum 46 (FIG. 2). Second/printer datum 40 includes a primary datum 48 (FIG. 2), a secondary datum 50 (FIG. 2) and a tertiary datum 52 (FIG. 2). Six datum points may be used to correctly position and constrain printhead assembly 12 in all six degrees of freedom of motion. Three datum points establish a plane as the primary datum, two datum points establish a line as the secondary datum, and one datum point establishes a point as the tertiary datum. In the example shown, assembly primary datum 42 includes datum points Z1, Z2 and Z3 establishing a horizontal plane, secondary datum 44 includes datum points Y1 and Y2 establishing a horizontal line, and tertiary datum 46 includes datum point X1. Printer primary datum 48 includes datum points Y1, Y2 and Y3 establishing a vertical plane, secondary datum 50 includes datum points Z1 and Z2 establishing a horizontal line, and tertiary datum 52 includes datum point X1. Thus, in this example, assembly datum 30 and the printer datum 32 share datum points Z1, Z2, Y1, Y2 and X1. Datum point Y3 is not used for assembly datum 30 and datum point Z3 is not used for printer datum 32.

Datum points X1, Y1-Y3, and Z1-Z3 are physically embodied on printhead assembly 12 as small reference surfaces and, accordingly, are referred to synonymously as datum points and reference surfaces. As shown in FIGS. 5-8, printer primary datum reference surfaces Y1, Y2, Y3 on printhead assembly 12 abut mating surfaces 54, 56, 58 on printer chassis 28. Printer secondary datum reference surfaces Z1, Z2 abut mating surfaces 60, 62 on chassis 28 and printer tertiary datum reference surface X1 abuts a mating surface 64 on printer chassis 28. As shown in FIGS. 9 and 10, assembly primary datum reference surfaces Z1, Z2, Z3 on printhead assembly 12 abut mating surfaces 66, 68, 70 on assembly fixture 33. Assembly secondary datum reference surfaces Y1, Y2 abut mating surfaces 72, 74 on assembly fixture 33 and assembly tertiary datum reference surface X1 abuts a mating surface 76 on fixture 33.

During manufacturing of a printhead assembly, individual components may be successively assembled to a main body part. The main body part should be constrained in all six degrees of freedom of motion to allow accurately assembling other components to the main body part. Thus, the main body part will include a full set of datum points. For printhead assembly 12 shown in the figures, lower body 34 serves as the main body part for assembly. Accordingly, lower body 34 includes all six assembly datum points Z1-Z3, Y1, Y2, and X1 as best seen in FIG. 2.

To optimize mounting the completed printhead assembly 12 in printer chassis 28, however, it may not be desirable to place all of the printer datum points on lower body 34. It is usually desirable to maximize the distance between datum points to improve the precision with which printhead assembly 12 can be placed in chassis 28. Lower body 34 is relatively short in the Z direction and long in the X and Y directions. While lower body 34 may be long enough in the X and Y directions for good datuming, it may not be long enough in the Z direction. Thus, the third datum point Y3 for printer datuming may be placed on upper body part 38 away from lower body 34.

Figure 7:
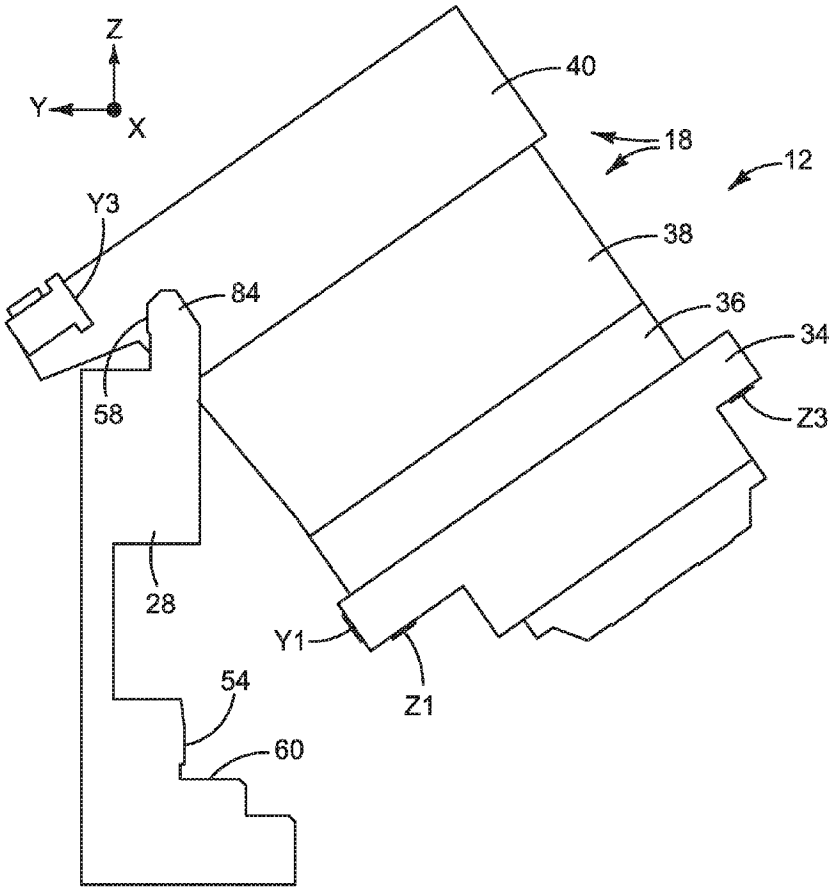

In the example shown, as best seen in FIGS. 2 and 3, upper body 38 includes an L shaped neck 78 that ends in a hook 80. Datum point Y3 is formed on the face of a pin 82 clamped to hook 80. The mating reference surface 58 is formed on the backside of a post 84 on chassis 28 (facing away from reference surfaces 54 and 56). This configuration for printer datum 32 allows the mounting structure shown in FIGS. 7 and 8 and described in detail in international patent application no. PCT/US2012/022818 titled PRINTHEAD ASSEMBLY DATUM and filed Jan. 27, 2012. Printhead assembly 12 is mounted to chassis 28 by hooking neck 78 over chassis post 84 as shown in FIG. 7, and rotating printhead assembly 12 into contact with the chassis datums as shown in FIG. 8. The hooked configuration for mounting printhead assembly 12 shown in FIGS. 7 and 8 utilizes the torque generated by the weight of printhead assembly 12 hanging from chassis 28 to help datum points Y2, Y3, Z1, Z2, and X1 into contact with the corresponding chassis reference surfaces 54, 56, 60, 62, and 64.

When mounted in a printer, printer primary datum 48 (Y1, Y2, Y3) establishes the correct translational position of printhead assembly 12 in the Y direction and the correct rotational position of printhead assembly 12 about the X and Z axes. A datum that constrains translation in the Y direction is commonly referred to as a "Y" datum. Printer secondary datum 50 (Z1, Z2) establishes the correct translational position of printhead assembly 12 in the Z direction and the correct rotational position of printhead assembly 12 about the Y axis. A datum that constrains translation in the Z direction is commonly referred to as a "Z" datum. Printer tertiary datum 52 (X1) establishes the correct translational position of printhead assembly 12 in the X direction. A datum that constrains translation in the X direction is commonly referred to as an "X" datum. For printer datum 32, therefore, primary datum 48 is a Y datum, secondary datum 50 is a Z datum, and tertiary datum 52 is an X datum.

When mounted in an assembly fixture, assembly primary datum 42 (Z1, Z2, Z3) establishes the correct translational position of lower body 34 in the Z direction and the correct rotational position of lower body 34 about the X and Y axes. Assembly secondary datum 44 (Y1, Y2) establishes the correct translational position of lower body 34 in the Y direction and the correct rotational position of lower body 34 about the Z axis. Assembly tertiary datum 46 (X1) establishes the correct translational position of lower body 34 in the X direction. For assembly datum 30, therefore, primary datum 42 is a Z datum, secondary datum 44 is a Y datum, and tertiary datum 46 is an X datum.

In the example configuration shown in FIGS. 2-8, printer primary datum points Y1, Y2, Y3 establish a vertical, Y datum plane 48 but not all three datum points Y1, Y2, Y3 lie in the same vertical plane. As best seen in FIG. 8, datum point Y3 is offset from points Y1 and Y2 in the Y direction. Thus, in this example, a projection Y3' of datum point Y3 in the Y direction lies in the same plane 48 as datum points Y1 and Y2. That is to say, datum plane 48 is defined by the three points Y1, Y2, Y3'. It is not necessary that all of the physical datum points lie in the same plane or along the same line to establish the corresponding datum. Rather, the physical datum points that establish a datum plane or a datum line may be offset from the other physical datum points and a projection used to define the plane or line with the desired position and/or orientation, as long as the projection has a fixed relationship to the corresponding physical datum point.

The translational and rotational degrees of freedom are described above with reference to X, Y and Z axes in a three dimensional Cartesian coordinate system, where the X axis extends in a direction laterally across the printhead assembly (which is laterally across a print zone perpendicular to the direction the print substrate moves through the print zone when the printhead assembly is installed in a printer), the Y axis extends in a direction along the printhead assembly (which is the same direction the print substrate moves through the print zone when the printhead assembly is installed in the printer), and the Z axis is perpendicular to the X and Y axes. In the examples shown, the X and Y axes extend horizontally and the Z axis extends vertically. This is just one example orientation for the X, Y, and Z axes. While this orientation for the X, Y, and Z axes may be common for many inkjet printing applications, other orientations for the X, Y, and Z axes are possible.

"A" and "an" used in the Claims means one or more.

As noted above, the examples shown in the Figures and described above do not limit the claimed subject matter, which is defined in the following Claims.

What is claimed is:

1. A datuming system to position a printhead assembly relative to a component external to the printhead assembly, the datuming system comprising:

a first datum on the printhead assembly to establish a first plane, a first line, and a first point; and a second datum on the printhead assembly to establish a second plane orthogonal to the first plane, a second line, and a second point.

2. The datuming system of claim 1, where:

the first datum is to position the printhead assembly relative to an assembly fixture; and the second datum is to position the printhead assembly relative to a printer chassis.

3. The datuming system of claim 1, where each datum includes three datum points establishing the plane, two datum points establishing the line, and one datum point establishing the point.

4. The datuming system of claim 1, where the first plane is a horizontal plane and the second plane is a vertical plane.

5. The datuming system of claim 1, where the first line lies in the second plane and the second line lies in the first plane.

6. The datuming system of claim 1, where the one point established by the first datum and the one point established by the second datum are the same point.

7. A printhead assembly, comprising:

a body;

a printhead attached to the body;

a first group of assembly datum reference surfaces on the body to abut mating surfaces on an assembly fixture to position the body for assembling the printhead assembly; and a second group of printer datum reference surfaces on the body to abut mating surfaces on a printer chassis to position the printhead for printing, the first group of reference surfaces being different from the second group of reference surfaces.

8. The printhead assembly of claim 7, where:

the assembly datum reference surfaces embody Z1, Z2, Z3, Y1, Y2, and X1 datum points; and the printer datum reference surfaces embody the Z1, Z2, Y1, Y2 and X1 datum points and a Y3 datum point.

9. The printhead assembly of claim 8, where:

the Z1, Z2 and Z3 datum points establish a datum plane for the assembly datum;

the Y1 and Y2 datum points establish a datum line for the assembly datum;

the Y1, Y2 and Y3 datum points establish a datum plane for the printer datum; and the Z1 and Z2 datum points establish a datum line for the printer datum.

10. The printhead assembly of claim 9, where:

the body comprises multiple body parts joined together;

the Z1, Z2, Z3, Y1, Y2 and X1 datum points are formed on a first one of the body parts; and the Y3 datum point is formed on a second one of the body parts connected to the first one of the body parts.

11. The printhead assembly of claim 10, where the Z1, Z2, Z3, Y1, Y2 and X1 datum points are all formed on a single body part.

12. A datuming system for a printhead assembly, comprising:

a first group of six datum points on the printhead assembly to position and constrain the printhead assembly in all six degrees of freedom of motion; and a second group of six datum points on the printhead assembly to position and constrain the printhead assembly in all six degrees of freedom of motion, the first group and the second group sharing some but not all datum points.

13. The datuming system of claim 12, where the first group and the second group share exactly five datum points.

14. The datuming system of claim 12, where:

the first group of six datum points includes:

Z1, Z2, and Z3 datum points to establish a first datum plane;

Y1 and Y2 datum points to establish a first datum line; and an X1 datum point to establish a first datum point; and the second group of six datum points includes:

the Y1 and Y2 datum points and a Y3 datum point to establish a second datum plane orthogonal to the first datum plane;

the Z1 and Z2 datum points to establish a second datum line; and the X1 datum point to establish a second datum point.

* * * * *